US007419465B2

(12) United States Patent
Ainley, Jr.

(10) Patent No.: US 7,419,465 B2
(45) Date of Patent: Sep. 2, 2008

(54) ANIMAL INSEMINATION SHEATH-METHODS OF USE

(76) Inventor: Frank Ainley, Jr., 38001 Rd. 197, Elderwood, CA (US) 93286

( * ) Notice: Subject to any disclaimer, the term of this patent is extended or adjusted under 35 U.S.C. 154(b) by 0 days.

(21) Appl. No.: 11/648,090

(22) Filed: Dec. 29, 2006

(65) Prior Publication Data

US 2007/0255092 A1 Nov. 1, 2007

Related U.S. Application Data

(63) Continuation of application No. 11/413,445, filed on Apr. 28, 2006, now Pat. No. 7,344,492.

(51) Int. Cl.
*A61D 7/00* (2006.01)

(52) U.S. Cl. ..... 600/35

(58) Field of Classification Search ..... 600/33–35, 600/184, 186, 201, 203, 462; 604/1–3, 93.01, 604/96, 181, 184, 187, 236, 238, 263, 264, 604/275, 510, 515, 906; 119/14.21, 174; 374/158, 209

See application file for complete search history.

(56) References Cited

U.S. PATENT DOCUMENTS

| | | | |
|---|---|---|---|
| 4,261,361 | A | 4/1981 | Cassou |
| 4,453,936 | A | 6/1984 | Cassou |
| 4,457,313 | A | 7/1984 | Alter |
| 4,493,700 | A | 1/1985 | Cassou |
| 4,522,621 | A | 6/1985 | Cassou |
| 4,662,360 | A | 5/1987 | O'Hara et al. |
| 4,846,785 | A | 7/1989 | Cassou |
| 5,293,862 | A | 3/1994 | O'Hara et al. |
| 5,474,542 | A | 12/1995 | Gabdu et al. |
| 5,800,411 | A | 9/1998 | Nakada et al. |
| 5,997,481 | A | 12/1999 | Adams |
| 6,347,243 | B1 | 2/2002 | Fraden |
| 6,511,415 | B1 | 1/2003 | Christine |
| 6,520,922 | B2 | 2/2003 | Michelle |
| 6,662,750 | B2 | 12/2003 | Anderson |
| 6,913,593 | B1 | 7/2005 | Alexandre et al. |
| 2001/0023310 | A1 | 9/2001 | Gourley |
| 2002/0193658 | A1 | 12/2002 | Simmet |
| 2003/0178440 | A1 | 9/2003 | Wright |
| 2003/0212307 | A1 | 11/2003 | Hladky |
| 2004/0068159 | A1 | 4/2004 | Neisz et al. |
| 2004/0162461 | A1 | 8/2004 | Christine |
| 2004/0199044 | A1 | 10/2004 | Verberckmoes |

*Primary Examiner*—John P Lacyk
(74) *Attorney, Agent, or Firm*—Mark D. Miller

(57) ABSTRACT

The present invention includes methods for artificially inseminating animals using an improved artificial insemination device that prevents contaminants from entering the opening at the end of an insemination sheath during insertion through the reproductive tract of an animal. A thin protective cover or membrane is provided at the tip of the sheath to seal it, the membrane being designed to rupture under the pressure from the seminal fluid being applied by the plunger used to eject the semen from the insemination gun. The protective cover can be an integrated portion of the sheath itself, or a material applied to the tip of the sheath. The protective cover is minimal in size as to not increase the diameter of the artificial insemination device so that there is no loss in tactile sensitivity to the breeder who must maneuver the invention through the animal's reproductive tract.

13 Claims, 9 Drawing Sheets

ANIMAL INSEMINATION SHEATH-METHODS OF USE

This is a continuation of application Ser. No. 11/413,445 filed on Apr. 28, 2006 now U.S. Pat. No. 7,344,492, which is incorporated herein by this reference.

BACKGROUND OF THE INVENTION

1. Field of the Invention

The present invention relates to animal insemination, and more particularly to methods and apparatus for inseminating livestock, particularly bovine and related animals.

2. Description of the Prior Art

The artificial insemination of livestock is a common practice, and extensive research and studies have been done to confirm the benefits including increased conception rates. A few devices are currently on the market for use in insemination, especially with respect to the cattle and dairy industry. Most devices currently in use include a syringe of some general design, which contains a unit of semen. The syringe is inserted into the reproductive tract of the animal to deposit the semen in such a location to ensure heightened reproductive success.

The primary goal of and benefit derived from artificial insemination is the ability to select and ensure the delivery of superior genetic traits and to provide improved pregnancy rates. Many factors can affect the pregnancy rate of a herd being artificially inseminated. One factor is the ability to detect when members of the herd are in heat and should be inseminated. Another is the general reproductive health of the female members of the herd. Another factor is the effectiveness of the semen. Another factor is the effectiveness of the artificial insemination procedure being used. Improving the first three factors requires close study of the herd, and testing the reproductive tracts and units of semen being used for any potential problems. A final factor, the effectiveness of the artificial insemination technique, is largely affected by the artificial insemination devices used, and the processes and techniques that are used. With regard to these issues, devices for artificial insemination have been created to be able to quickly and safely deliver semen to a given animal. While a few devices are on the market, there are disadvantages to such devices that either lower their efficiency or make them difficult to use, dissuading a large percentage of technicians from choosing to use them.

Pregnancy efficiency levels are critical since they correlate directly to the cost of breeding livestock. If efficiency is low, more insemination attempts will be needed on average to impregnate a given animal. This translates to a loss of time and profit while the animal is not pregnant, labor costs for the breeder to continue the insemination attempts on the animal, the money cost for more semen to be used, and extra insemination supplies needed for the extra attempts. Thus, an overall increase in efficiency can greatly increase the profitability of a given herd.

One of the more common devices used for the artificial insemination is a gun or syringe having a plunger rod inside that may be enclosed within a sheath. Such a device is disclosed in U.S. Pat. No. 4,493,700. In such a device, a straw containing a unit of semen is placed into the tubular body of the gun, and the sheath placed over the gun-and-straw combination. The contents of the straw may be expelled when the plunger inside the tubular body is depressed. A typical semen straw is sealed at one end by cotton plugs, and at the other end by a crimp seal. When the straw is ready for use, the crimped end of the straw is cut off, opening this end of the straw for passage of the semen. The straw is then inserted into the tubular body of the gun, with the closed end against the plunger, and the open end extending out from the tubular body. Then, the plastic sheath is placed over the tubular body and straw. Both ends of the sheath are open, with the proximal end being of a slightly larger diameter in order to receive the semen straw and tubular body, the distal end having a more narrow frustoconical pointed end or tip. The open split (proximal) end is secured to the gun by means of a locking ring. The tip of the sheath (distal end) is pointed but open to allow for the delivery of semen from the straw. The sheath-covered "loaded" gun is then inserted into the vaginal tract of the animal to be inseminated and, at the proper location, semen is delivered by depressing the plunger. It is to be appreciated that proper insertion and maneuvering of the sheathed gun involves considerable skill as the technician must first direct the pointed end of the sheathed gun assembly through the vaginal canal, then to and through the cervix, and finally to an optimum delivery point at the entrance of the uterine body before the semen is delivered. The slender makeup of such devices makes them well suited for such maneuvering. However, the open-ended sheath suffers from the significant drawback of potential loss of sterility during the long journey to the delivery point, such that even if delivery is made at an optimum location, the semen may have become contaminated along the way rendering it ineffective and/or unusable.

The vaginal canal of most livestock may be unsanitary, the passageway containing bacteria, yeast, and other deleterious organisms. Another problem with bovines is that the vagina is located below the anus, and as such, it is commonplace for some amount of manure to find its way into the vaginal cavity. The manure by nature is unsanitary, and if it is introduced into the cervix or uterus, it will most likely lower reproductive levels to a minimum and cause infection and/or disease. The open-tipped insemination gun may come into contact with and collect these contaminants as it passes through the vaginal cavity, causing them to be deposited with the semen at the delivery point. It is therefore desirable to provide methods and apparatus for artificial insemination that assure sanitary and efficient delivery of the semen to the uterine body.

This problem is partially addressed in U.S. Pat. No. 4,457,313. The devices disclosed in this patent use a disposable rigid protective or outer sheath that fits over the inner sheath of the insemination gun to maintain the sterility of the inner sheath and semen straw inside. The outer protective sheath is formed of a hard plastic and is not as long as the inner sheath. The outer sheath is provided with a perforated rubber cap at one end and a flared gripping surface at the other. The rubber cap prevents contaminants from entering the open end of the pointed sheath and semen straw inside during the long trip through the reproductive tract. When the delivery point is reached, the flared gripping surface is grasped and pulled, sliding the outer sheath relative to the inner sheath (which is why it is shorter than the inner sheath), and causing the inner sheath to push or poke through the perforated rubber cap. The semen can then be delivered by depressing the plunger.

Unfortunately, devices of this sort suffer from numerous drawbacks. The most significant is the obstacle created by the large rubberized cap. While this cap aids sterility, it is bulky and tends to get caught or snag during the trip through the vagina, and is likely to become entangled or stopped (plugged) in the fibrous tissues of the cervix. This makes it difficult for the user to maneuver the tip to the optimum location for deposit of the semen. For smaller animals, the cap may simply be too large to even fit into the cervix. In either case, the rubberized cap prevents the gun from being maneuvered all the way to the uterine body for optimal semen delivery. As a result, at the point where the rubber cap prevents further insertion, the inner sheath must then be pushed through the perforated end of the cap to travel further toward its destination. If the cap has bogged down in the vagina, extending the inner sheath will expose it to the very contaminants sought to be avoided. If the cap has made it to the cervix, further contaminants may still be picked up. In either case, the now bogged-down cap tends to inhibit further maneuvering of the inner sheath (which is passing through it), leading to imprecise positioning and less than optimum deposition of semen. In addition, since the outer protective sheath is of a certain length, even when the user extends the inner sheath the maximum distance through the perforated end of the cap (this distance is the difference between the lengths of the inner and outer sheaths), there is only so much traveling space before the outer sheath rests upon the base of the gun at the plunger, thereby preventing the inner sheath from traveling any further on its own. Oftentimes, this distance is less than the length of the cervix, thereby preventing the tip of the inner sheath from reaching the optimum location at the entrance of the uterine body, decreasing the chances of fertilization.

Another drawback is that the use of the outer sheath increases the size and diameter of the insemination gun, which already includes a first sheath placed over the gun tube, plunger and semen straw. The outer sheath is loosely attached (so that it can slide against the inner sheath), making it more difficult to maneuver. All of these things inhibit the technician from feeling the depth of the insemination gun, contributing to a general lack of ability to feel the placement of the tip of the gun, and making it less likely to deposit the semen in an optimal location.

Because of these problems, many breeders have a difficult time inseminating animals with such devices, and oftentimes choose to use the unsanitary gun or sheath without the protective device. This is usually because the insemination process is based largely on the "feel" the breeder has leading the device through the reproductive tract of the animal, and the sense of location that an experienced breeder acquires though repeated breeding. When breeders discuss "feeling" placement of the artificial insemination gun in the reproductive tract, a central focus is on the travel of the instrument to and though the cervix. The cervix is much more rigid than the vaginal lining, and creates more resistance on the artificial insemination instrument. Depending on the animal and its age, the size, shape, and diameter of the cervix can vary greatly. In general, the cervix in both older and larger livestock is larger and longer than that of younger, smaller livestock. Often times, the angle at which the cervix rests is more downward with an older animal. These differences in cervix size and shape underscore the problems with many of the sanitary devices currently on the market.

Other devices have also been developed to attempt to further sanitize the process. One such device is disclosed in U.S. Pat. No. 4,453,936. This device is a sleeve of thin plastic material such as a film, which covers the gun and inner sheath. The gun is inserted in the reproductive tract of the animal with the film in place over the gun, and once the gun is in the proper location to inseminate the animal, the technician pulls on the film to create a lateral force to tear the film by the pressure on the sleeve at the end of the gun, thereby allowing a passage for the semen from the tip of the inner sheath. Many problems have been encountered with such devices, malting them unpopular to breeders and rarely used. While the sleeve is intended to make the insemination process more sanitary, it is found that the sleeve bunches in places during insertion creating pockets where contaminants from the vagina are carried further into the cervix and uterus actually increasing the chance of infection. Another problem with such devices is that the edge of the sleeve where the plastic film is connected tends to cut the vaginal lining, causing bleeding in the animal. This causes general discomfort for the animal and increases the chance for infection. It is also known that blood can kill sperm. Finally, many breeders also complain that the film sleeve affects the "feel" needed to properly inseminate the animal.

It is therefore desirable to provide methods and apparatus for providing sanitary artificial insemination of a wide variety of livestock, while also allowing the breeder to have the necessary tactile sensation for proper placement of the insemination gun for delivery of semen at an optimal location to improve the chances of fertilization.

SUMMARY OF THE INVENTION

The present invention provides an artificial insemination apparatus and methods for use with livestock that maintains the sterility of the semen until it is deposited at an optimum location in the reproductive tract of the animal without the maneuvering or tissue injury problems associated with prior art devices. An apparatus of the present invention comprises a thin protective cover or membrane provided at the tip of a sheath that is placed over an artificial insemination gun. The membrane is made of a thin rubberized material that seals the open tip of the sheath to prevent contaminants from entering the sheath during the trip through the reproductive tract of the animal. The membrane is designed to rupture under the pressure from the seminal fluid being provided by the force of the plunger of the insemination gun. The protective membrane can be an integrated portion of the sheath itself, or a material applied to the tip of the sheath. The membrane is minimal in size so as to not increase the diameter of the artificial insemination device, and does not require any additional sheath or film that might otherwise interfere with maneuvering the device. As a result, the present invention allows the breeder to have optimum tactile sensitivity for proper placement of the device and deposit of semen. Methods for using and producing the apparatus are also disclosed.

One embodiment of the apparatus of the present invention is a thin layer of a plastic or rubberized material coated on the tip of a standard plastic sheath ordinarily used with an artificial insemination gun. Such a sheath comprises a long cylindrical tube having a slightly larger diameter than the cylinder of the insemination gun allowing for the semen straw and gun assembly to fit inside the sheath. One end of the sheath is tapered to a tip having a hole or aperture therein. The tapering of the tip generally results in the circumference of the opening at the end of the sheath being smaller than the circumference of the semen straw. This prevents the semen straw from exiting through this opening, and provides a surface to brace the straw in place between the gun assembly and the sheath.

The opening in the tip is blocked by the thin protective cover or membrane of the present invention. This may be accomplished in a number of different ways. In one embodiment, the open-ended tip of an existing sheath may be dipped into a rubberized material which cures onto the end, sealing the opening. Depending upon the type of material used, the material may cure on the inside of the tip forming a thin plug, or it may cure over the outside of the tip forming a thin cap. In either case, a complete seal of the opening in the tip is provided. The amount of coating material used in the present invention may also vary. The coating may extend beyond the opening at the tip of the sheath, but it is only required to extend far enough down the tip to ensure full closure of the hole. It is preferred that the coating not extend beyond the tapered end of the sheath so as not to increase the overall diameter of the sheath.

The thickness of the covering may vary, so long as it has enough tensile strength to keep it from rupturing or tearing during the trip through the animal's reproductive tract, but may be ruptured in the presence of pressure normally provided by the plunger of the insemination gun during the insemination process. Upon the application of sufficient pressure, the membrane or cover ruptures or splits open, allowing the semen to pass through for deposit into the reproductive tract of the animal. The rupture or split occurs in such a manner that no fragments of the membrane are left in the cervix or uterus of the animal. The elasticity of the coating material tends to keep the material together and to keep it attached to the sheath even though it has been torn.

In an alternative embodiment, the sheath may include an integrated pre-scored, weakened or perforable cover for the tip that is made out of the same material as the rest of the sheath. In this embodiment, the material covering the opening at the tip of the sheath is much thinner than that of the rest of the sheath. When pressure is applied to the sheath, the thinner layer of material at the tip of the sheath splits or ruptures along the pre-scored areas, allowing for passage of the semen into the reproductive tract of the animal.

The covering can be applied to the sheath in several different methods. One method involves the use of a liquid polymer substance that once cured forms an elastic seal over the opening at the tip of the sheath. Such a layer of covering is created by dipping the tip in a liquid polymer solution, and then removing the tip of the sheath and allowing the solution to cure. In one variation, the liquid polymer used is PLASTI DIP® rubber coating. The tip of the sheath is dipped in the liquid polymer, sealing the hole at the end of the tip. The sheath is then removed from the polymer, and the polymer on the tip is allowed to cure for about 15 minutes. Other liquid polymers may be used to create a similar coating. In some embodiments, depending on the type of coating material used, the tip of the sheath is held in a vertical direction and dipped in a downward direction in the liquid polymer, and shortly afterwards may be placed horizontally on a surface to cure.

In one method, depending on the type of coating material used, the tip of the sheath is dipped just far enough to cover the first rounded corner at the very end of the sheath, but not allowing it to come very far up the frustoconical tapered edge of the tip. However, if the sheath is not dipped far enough, and the coating just covers the opening and the very outside edge of the sheath, the thickness across the opening may be too thin and could rupture prematurely. Conversely, if the tip of the sheath is dipped too far and allowed to come a significant distance up on the tapered edge of the tip, the thickness of the coating over the opening may be too thick and take excessive pressure to rupture the seal, or prevent the seal from rupturing under normal pressure from the gun.

The process of using the sealed sheath of the present invention with an insemination gun first requires preparation of the semen straw and gun. A unit of semen contained in a straw is thawed from a frozen state. The semen straw is completely sealed, having a slidable plunger seal at one end and a plastic (crimp) seal at the other end. Once thawed, the crimped end of the straw is cut off. The semen straw is then inserted into the insemination gun, with open end extending out. The gun comprises a cylindrical tube of slightly larger diameter than the semen straw, in which an elongate plunger mechanism is situated. The straw is inserted into the tube and the plunger mechanism of the insemination gun rests upon the slidable plunger seal at the base of the semen straw. The plastic insemination sheath of the present invention is then placed over the length of the gun. The insemination sheath is approximately the same length as the gun such that the base of the sheath (proximal end) fits snugly against a flared lower portion of the gun tube. The cylindrical tube of the artificial insemination gun flares out slightly to a larger diameter at the base to allow for the sheath to be properly attached. An "O" ring is then slid over the plastic sheath and is locked into place over this larger diameter area near the base of the gun, holding the proximal end of the sheath firmly against the gun tube. The plunger of the gun should be depressed to the point of contacting the cotton plunger in the semen straw. Because of the narrow circumference of the sheath tip (distal end), it is not possible for the semen straw to exit the sheath and gun assembly. At this point in time, the gun is prepped, and the unit of semen is loaded and open, but remains sealed to the external environment because of the sealed coating at the tip of the sheath.

The breeder then inserts the gun in the reproductive tract of the animal in the usual fashion. In one method, the breeder inserts the gun the majority of the length of the vagina, and then using his or her other hand, proceeds to gently wipe off the tip of the sheath to ensure that no contaminants are stuck or lodged near the tip. This is possible due to the elastic nature of the intestinal and vaginal lining through which the breeder can feel and manipulate the tip. The tip of the sheath is then inserted and navigated into the cervix of the animal.

In one aspect of the method, once the tip of the gun is positioned part way into the cervix, beyond any possible contaminants, the breeder depresses the plunger or other mechanism of the insemination gun. The pressure created from the seminal fluid and air trapped in the semen straw creates pressure within the gun that ruptures the sealed coating at the tip of the sheath. This early rupture is sometimes done as an additional precaution to expel any contaminants that may be on the tip of the sheath. By rupturing the seal, such contaminants are expelled into the cervix rather than in the uterus. Another reason for the early rupture is that the sealed end may balloon out slightly before actually bursting, and the act of rupturing the seal requires a slight movement of the semen gun. It is better that such ballooning and movement of the gun occur in the cervix cavity, rather than in proximity to the tender uterine body. The early rupture ensures that the gun is fully prepped for depositing the semen before reaching the uterine body.

The breeder will feel the release in pressure from the plunger when the seal is broken, at which point the breeder stops applying pressure so that the majority of the semen remains in the semen straw. Any air trapped in a semen straw is always at the open end of the semen straw, further limiting semen loss. The breeder then navigates the tip of the insemination gun to the appropriate area in the uterine body where the semen is to be deposited. At this point, the breeder then depresses the plunger or other mechanism to release the semen into the uterine body. If the seal has not already been ruptured, this pressure will rupture it. Once the semen is deposited, the gun is removed from the animal, and the used outer sheath is discarded along with the used semen straw.

In another embodiment, when the tip of the gun is in position, the breeder depresses the plunger to expel the semen from the semen straw. This pressure created by the fluid against the coating is enough to rupture said coating, thereby allowing the contents of the semen straw to be expelled through the ruptured opening. The amount of force it takes to rupture the opening is minimal but could slightly affect the ability of the breeder to hold the gun in position while injecting the semen. Sometimes the breeder will apply pressure to the plunger using the breeder's chest.

In an alternative embodiment, the covering of the opening is an integrated layer of plastic of the sheath. In this embodiment, there is no opening, but rather a thin layer of plastic covering on the opening that prevents contaminants from entering into the sheath, this thin plastic has the capability of being perforated or tom by the pressure of the semen being expelled.

Because of the small and thin nature of the covering on the sheath of the present invention, it does not affect the movement of the gun, or the tactile sensitivity of the gun to the breeder, allowing the breeder to properly navigate the tip of the gun to the proper location for discharge of semen at an optimum location in the uterine body.

Preliminary data confirms that higher pregnancy rates are obtained through use of the present invention. In 18 years of breeding the applicant achieved an average overall pregnancy rate of about 34%. Using the present invention on the first 1100 head, the applicant achieved an average overall pregnancy rate of approximately 46%.

In addition to increasing pregnancy rates, a further benefit of the present invention is a reduction in the rate of ovarian cysts in animals inseminated compared to animals inseminated by the prior art. Cystic ovaries is a condition that naturally occurs in a small percentage of animals, the occurrence of which lowers reproductivity rates in said animals. A cystic state can approximate that of the animal being in estrous causing a breeder to attempt to inseminate the animal to no effect. In addition, ovarian cysts require medical attention to prevent harm to the reproductive tract. The treatment for cysts takes usually at least 3 weeks, which is time lost for the possible insemination of the animal. The exact cause of ovarian cysts is unknown, but it is possible that the reduction in cysts is based on the fact that the present invention creates less irritation to the animal's reproductive tract when used due to the increased level of sanitation and reduction in circumference in the device. The use of the prior art large rubber tipped sheath protector is a possible cause of trauma to the reproductive tract and likely causes the secretion of prostaglandin which would trigger a short heat cycle, and an infertile heat The use of the present invention reduces the trauma level of the animal due to its reduced size, which is potentially a direct corollary to reduced numbers of cystic ovaries.

Another concern with inseminating animals is the possibility of infection. Oftentimes, if an animal is subject to an infection in the reproductive tract, the animal will skip a reproductive cycle. Such an infection could be caused by the contaminants deposited in the reproductive tract that were picked up by an unsealed sheath tip. The reproductive cycle for cattle is roughly 3 weeks. If an animal is infected, and skips a reproductive cycle, then the breeder will have to wait 6 weeks before insemination can be attempted, and incur an overall loss of revenue.

It is therefore an object of the present invention to improve pregnancy rates among artificially inseminated livestock by providing methods and apparatus for avoiding contamination of semen to be deposited during artificial insemination that do not interfere with the breeder's navigation of the insemination device through the animal's reproductive tract.

It is a further object of the present invention to provide a sheath for use with an artificial insemination gun having a thin seal at the pointed end thereof to prevent contaminants from entering the sheath as it travels through the reproductive tract of an animal, the seal being rupturable upon the application of the pressure used to discharge the semen.

It is a further object of the invention to provide a protective seal for an artificial insemination sheath without the need for another larger sheath or plastic film covering.

It is a further object of the invention to provide a protective cover for an artificial insemination sheath that does not affect the tactile sensation of the breeder navigating the gun to the proper location within the reproductive tract of an animal.

It is a further object of the invention to provide cost effective and efficient methods for avoiding contamination of semen used in artificial insemination of livestock.

It is further object of the invention to provide methods for installing a protective cover on a standard artificial insemination sheath.

Additional objects of the invention will be apparent from the detailed descriptions and the claims herein.

DETAILED DESCRIPTION

Figure 1:
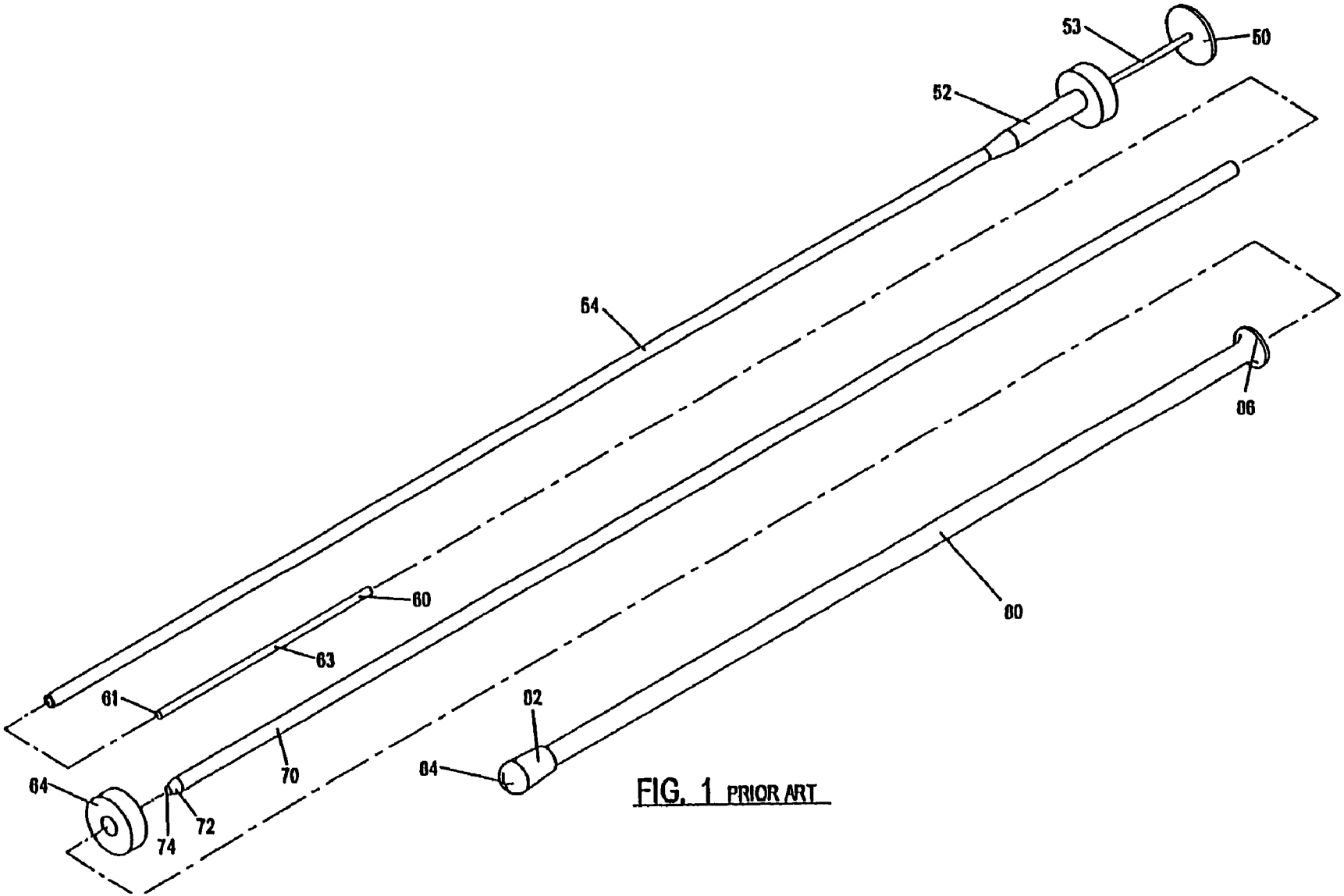
FIG. 1 PRIOR ART
FIG. 1 is a schematic view of a prior art artificial insemination gun using a sheath protector having a large rubberized cap at the end.
Figure 2:
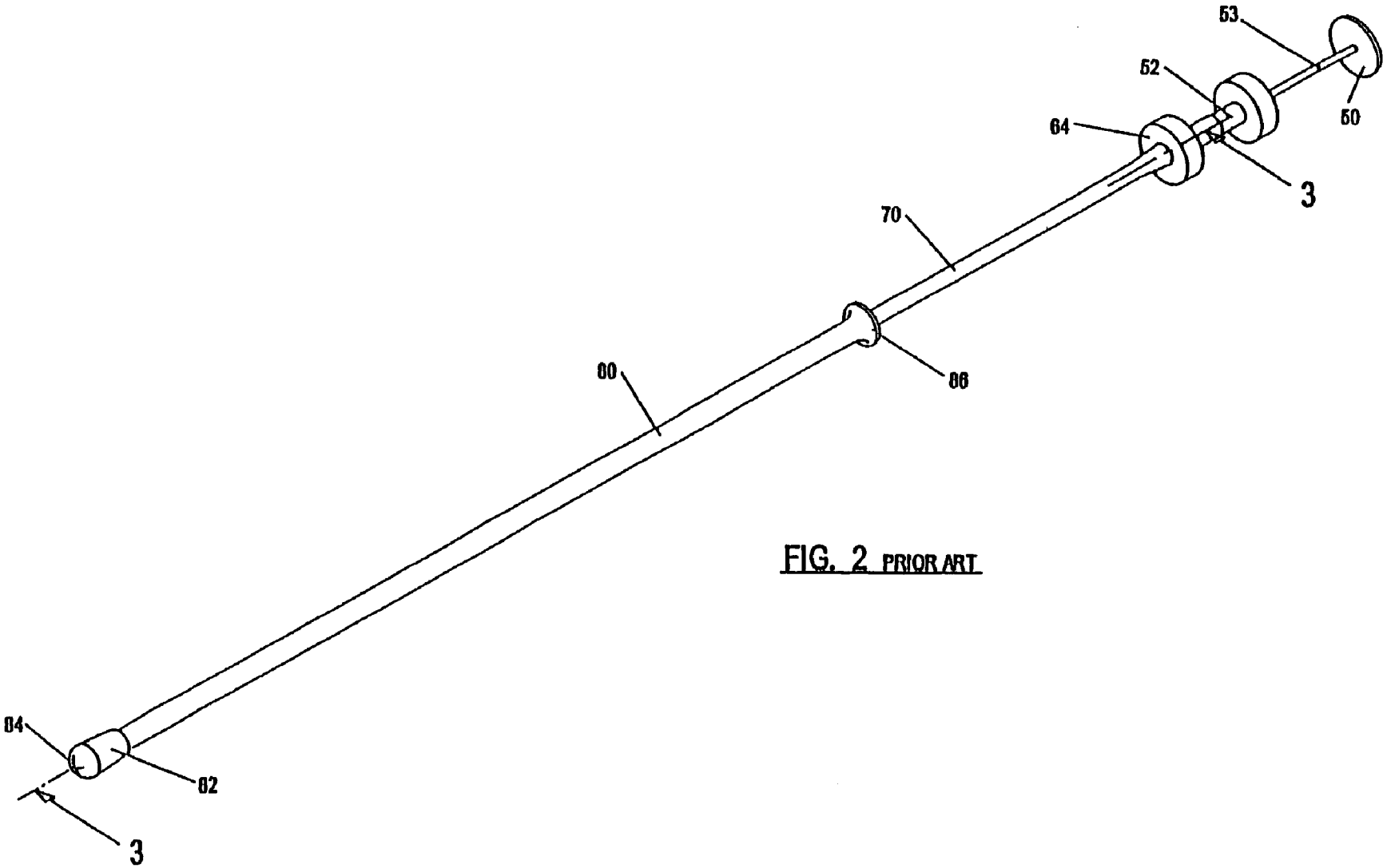
FIG. 2 PRIOR ART
FIG. 2 is a side perspective view of the prior art embodiment of FIG. 1 in an assembled state, prior to use.

Referring to the drawings wherein like reference characters designate like or corresponding parts throughout the several views, and referring particularly to the prior art devices of FIGS. 1 and 2, it is seen that the artificial insemination gun, used particularly for bovines, comprises a tubular body 54 provided at one end with a head 52 for fixing a sheath and terminating in an annular flange 50 that is held in the technician's fingers. Adjacent to its other end, body 54 has a counterbore defining an inner shoulder against which bears one end of a supply of semen or straw 63 provided with a piston-plug 60. Body 54 further comprises a plunger-rod 53 which is slidably mounted in the body so as to be capable of shifting by an end thereof the piston-plug 60 and consequently ejecting the semen contained in the straw 63. At its other end, the plunger-rod 53 has a flange 50 for pushing when dislodging semen. Body 54 and the plunger-rod 53 are, for example, made from stainless steel.

The gun is completed by a cylindrical breeding sheath 70 which slides over and covers the whole of the body 54 and the straw 63. The straw 63 bears by its front end against the inner surface of a convergent portion 72 of this sheath which has an ejection orifice 74. At its other end, the sheath is elastically clamped against a flared frustoconical portion of the head 52 by means of a clamping or "O" ring 64. The semen straws are crimp sealed on one end, and the crimped end of the straw is removed before use, creating an opening 61 through which the semen can be expelled. Sheath 70 is disposable, and is employed for each insemination operation and is slipped over the gun before its insertion into the reproductive passages of the animal. The sheath 70 is discarded once the apparatus has been withdrawn from the animal, so that the gun body 54 is not soiled and may be again employed without inconvenience on another animal after having been covered with another sheath.

Once the straw 63 is in place, the sheath 70 is slid over the artificial insemination gun body 54 and the semen straw. The sheath is made of a thin plastic material that is of slightly larger diameter than the body 54 of the insemination gun. When the open end of the semen straw 61 reaches the convergent portion of the sheath 72, a snug and/or airtight fit is accomplished and creates a seal with the convergent portion of the sheath 72. This seal is maintained by a locking ring which is slid over the sheath 70, and is of a diameter just slightly larger than a portion of the base of the sheath, as to allow the locking ring 64 to be manually secured on the sheath by applying downward force on the ring 64. Once secured, the semen straw 63 is secured in place as the tip of the sheath 72 narrows in diameter creating a lip or edge preventing the semen straw from exiting the sheath.

After securing the sheath 70 in the prior art embodiment of FIGS. 1 and 2, a protective or outer sheath 80 may then be placed over the inner sheath 70. The outer sheath 80 is made of a thicker plastic material and is of a diameter large enough that it fits loosely over the inner sheath 70. The outer sheath 80 is shorter in length than the inner sheath 70. The tip of the prior art outer sheath 80 is covered by a rubberized cap 82. The rubberized cap 82 has slits 84, usually formed in an "x" pattern, which allow the inner sheath 70 to be extended though the tip 82 by applying downward pressure on the flared edge 86 of outer sheath 80 with respect to the inner sheath 70 and the rest of the insemination gun apparatus 54. The outer sheath 80 and cap 82 are intended to cover the inner sheath 70 while the insemination gun assembly 54 is traveling through the vagina where contaminants might otherwise enter through opening 74 in sheath 70.

FIG. 1 is a schematic view of the components of the artificial gun assembly of the prior art insemination device. FIG. 2 depicts an embodiment of the prior art artificial insemination sheath in an assembled state. As shown, the outer sheath 80 is of a shorter length than the inner sheath 70. The end of the outer sheath has slits 84, but remains in a closed position while resting on the end of the tip of the inner sheath. 70. Once the device is inserted to the base of the cervix of the animal the breeder applies downward pressure on the flared section 86 of the outer sheath to force the tip 72 of the inner sheath 70 through the slits 84 of the rubber tip 82 of the outer sheath 80. The outer sheath can then slide downward until the flared section 86 comes in contact with the locking ring 64. This gives the breeder a section of the inner sheath, which is thinner, to insert into the cervix of the animal, before hitting the rubberized tip 82 of the outer sheath. This also allows the breeder to expel the semen as the upper opening 61 of the semen straw 63 corresponds to the opening 74 at the end of the inner sheath 70 and is no longer covered by the rubberized tip 84.

Figure 3:
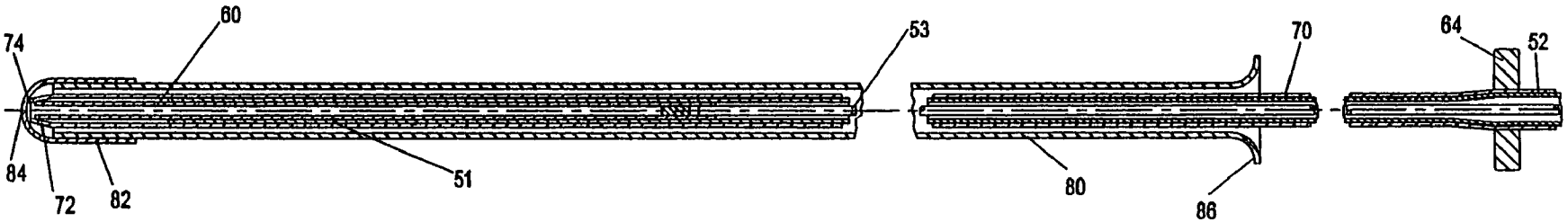
FIG. 3 PRIOR ART
FIG. 3 is a side cross-sectional view of the embodiment of FIGS. 1 and 2.

FIG. 3 is a cross sectional view of one embodiment of the prior art apparatus. It shows the relative diameter of each individual component part. Comparing to FIG. 6, which is a cross-sectional view of one embodiment of the present invention, it is noteworthy that the diameter of the present invention is the same as that of the inner sheath of the prior art invention of FIGS. 1-3.

Figure 4:
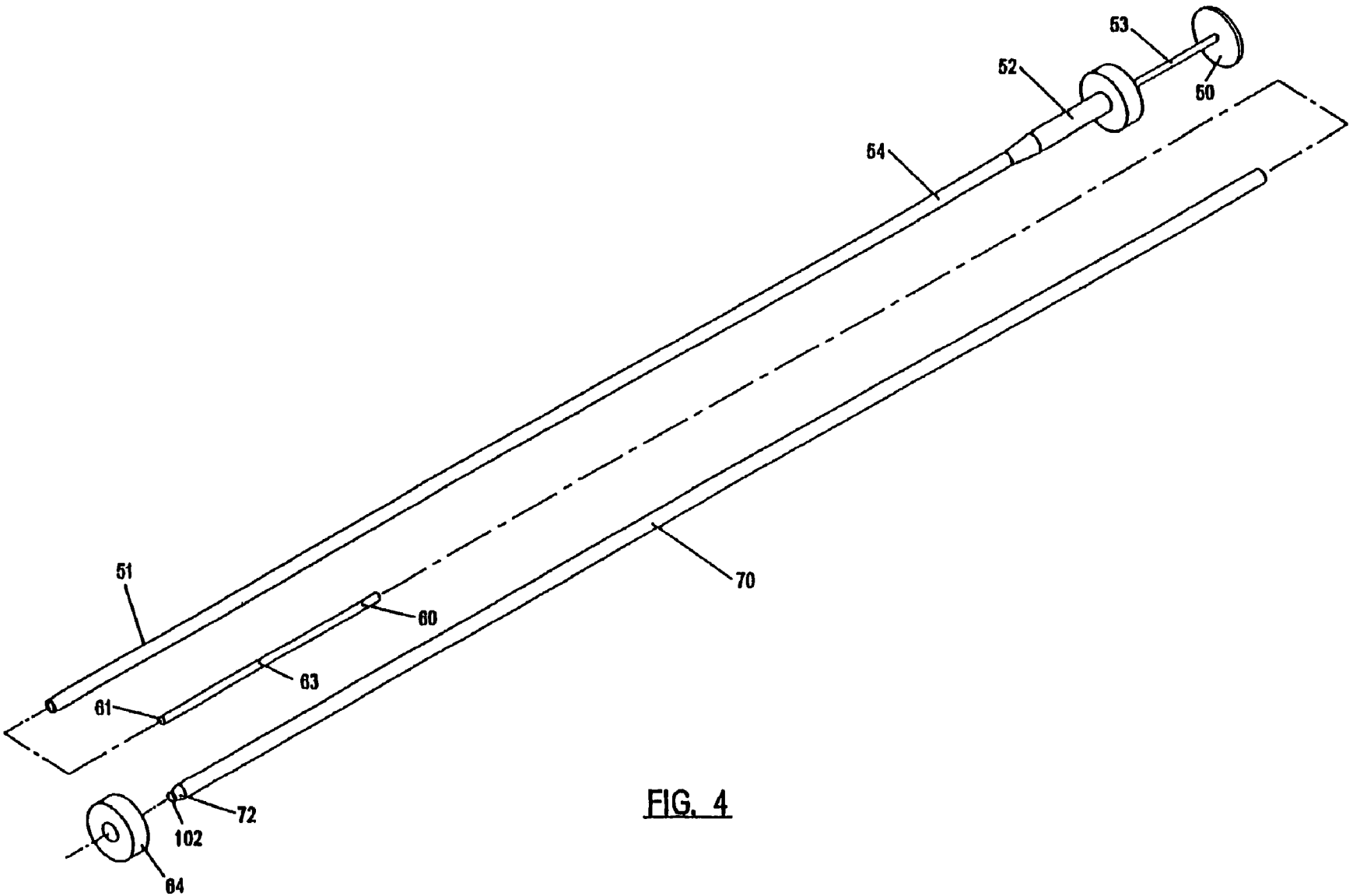
FIG. 4 is a disassembled side schematic view of one embodiment of the artificial insemination apparatus of the present invention.
Figure 5:
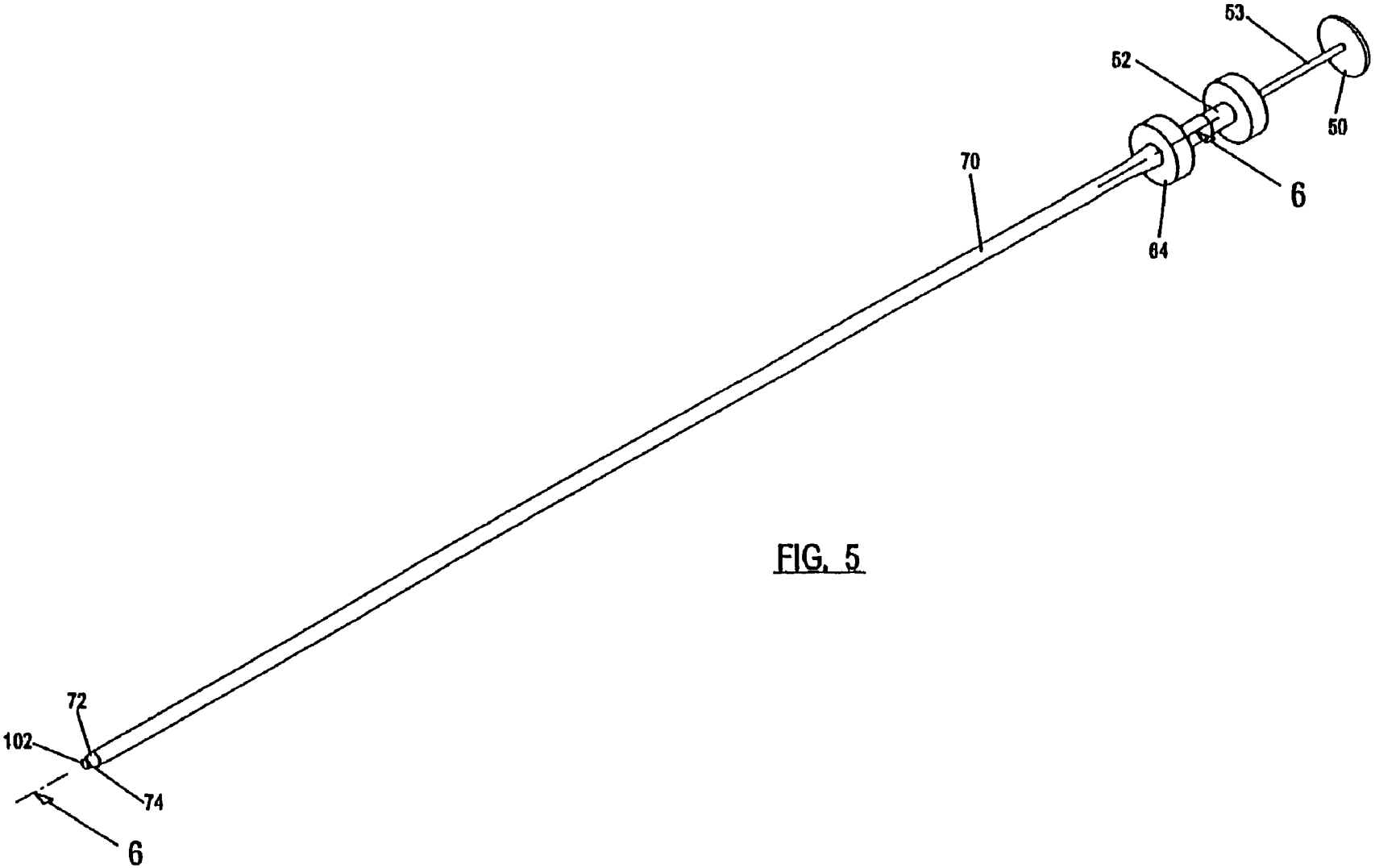
FIG. 5 is an assembled side perspective view of one embodiment of the artificial insemination apparatus of the present invention.

FIG. 4 is a schematic view of one embodiment of the present invention. The present invention relates to an improved sheath 70, which slidably fits over a standard artificial insemination gun assembly 54. A semen straw 63 is inserted into the artificial insemination gun at the distal end 51 in the same manner as previously discussed in the prior art invention. In addition, the sheath 70 is then slid over the loaded artificial insemination gun and secured using ring 64 in the same manner as the prior art sheath. FIG. 5 shows an assembled gun apparatus of the present invention including a sheath 70 with covering 102 over the opening 74 at the tip.

Figure 6:
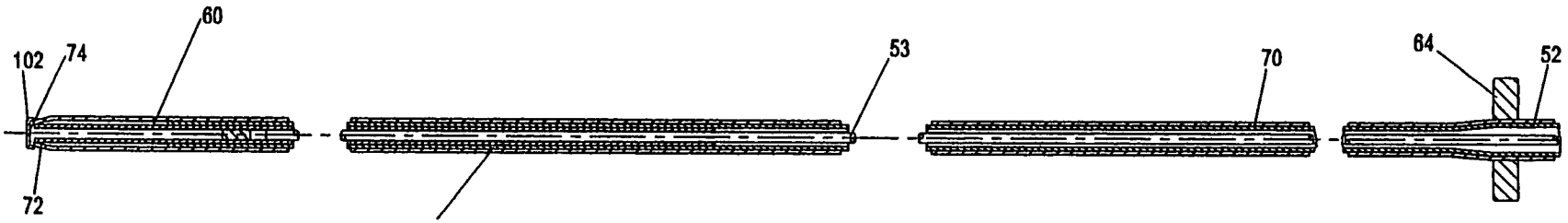
FIG. 6 is a side cross-sectional view of the embodiment of FIG. 5 along line 6-6.

As shown in the cross-sectional view of FIG. 6, the tip 72 of the sheath 70 is tapered, narrowing to a smaller diameter. Tip 72 may have a frustoconical shape. The smaller diameter is less than that of the diameter of the semen straw 63 which is enclosed between the gun end 51 and the tip 72 of the sheath 70 (see detail of FIG. 10). The opening 74 at the tip of the sheath is sealed by a coating 102. In the illustrated embodiment, coating 102 not only completely covers opening 74 but may also extend a distance down the tapered side of tip 72 to ensure that the tip is completely enclosed. In other embodiments, coating seal 102 may be provided in the form of a thin plug on the inside of tip 72 to prevent materials from passing through opening 74.

Figure 7:
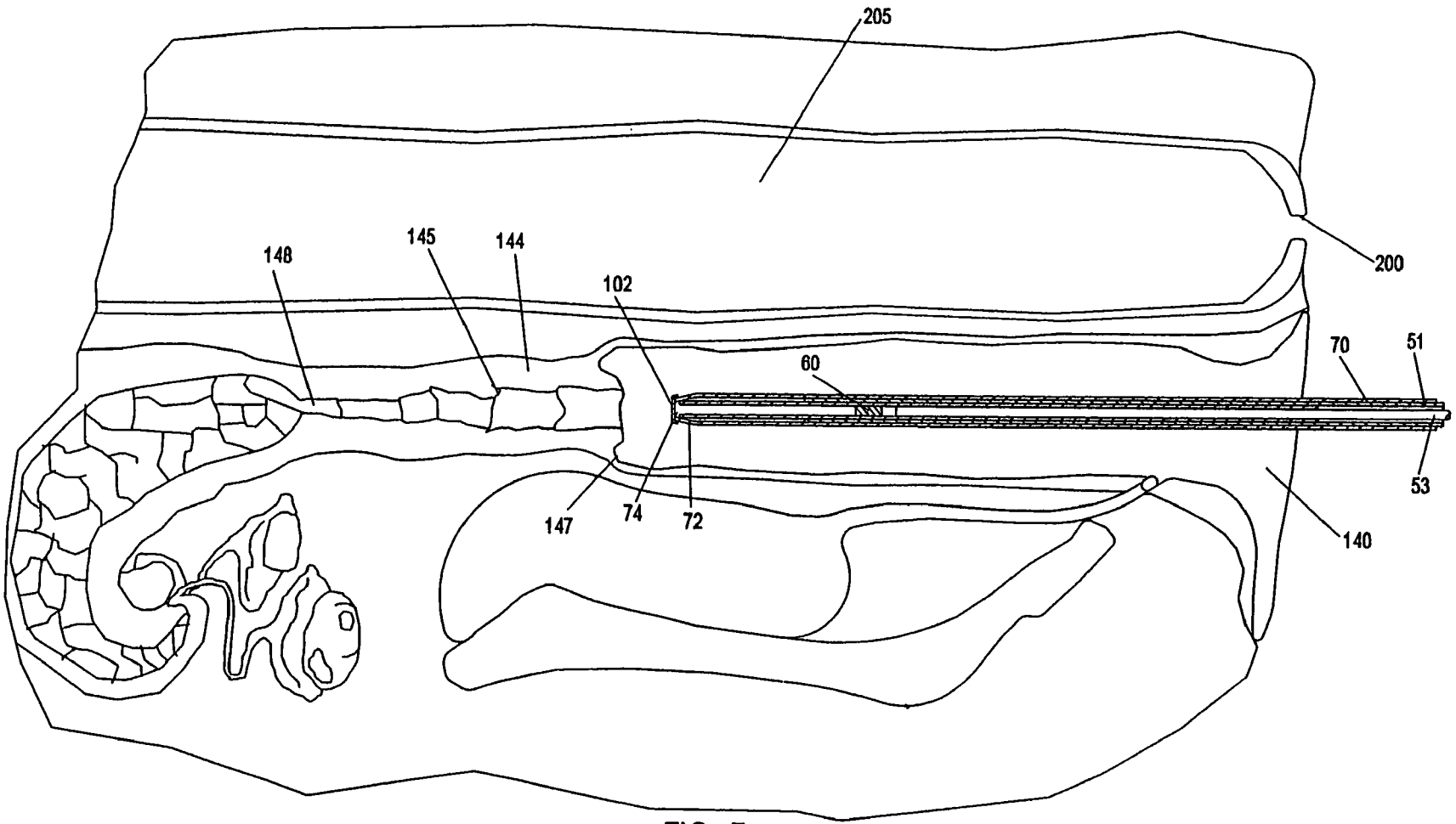
FIG. 7 is a cross-sectional side environmental view of one embodiment of the present invention inserted in the vaginal cavity of a bovine.

FIG. 7 is a cross sectional view of the artificial insemination gun of the present apparatus inserted in the vagina of a bovine. The figure depicts the basic structure of the reproductive tract of a bovine or other livestock. The animal has an anus 200 at the end of the animal's intestinal tract 205. With regard to bovines and other large livestock, the breeder inserts a hand through the anus 200 and into the intestinal tract 205 of the animal. The walls of the intestinal tract of the animal are thin and elastic allowing the breeder to feel and manipulate portions of the reproductive system through the wall of the intestines. The reproductive system of livestock, particularly a bovine, consists of a vagina 140 which extends a distance into the animal to the internal reproductive bodies. The vagina 140 extends to the cervix 144. In general, the cervix is more narrow and rigid than the vagina. The cervix has cervical rings 145 making passage through the cervix 144 difficult. At the end of the vagina 140, there are blind pouches 147, where the vaginal body extends slightly past the opening to the cervix 144. Often times the blind pouches can present an obstacle to the breeder in attempting to insert the artificial insemination gun into the cervix 144. At the end of the cervix is the uterine body 148. The rate of pregnancy is highest when sperm-containing semen is injected as close as possible to the uterine body 148.

Figure 8:
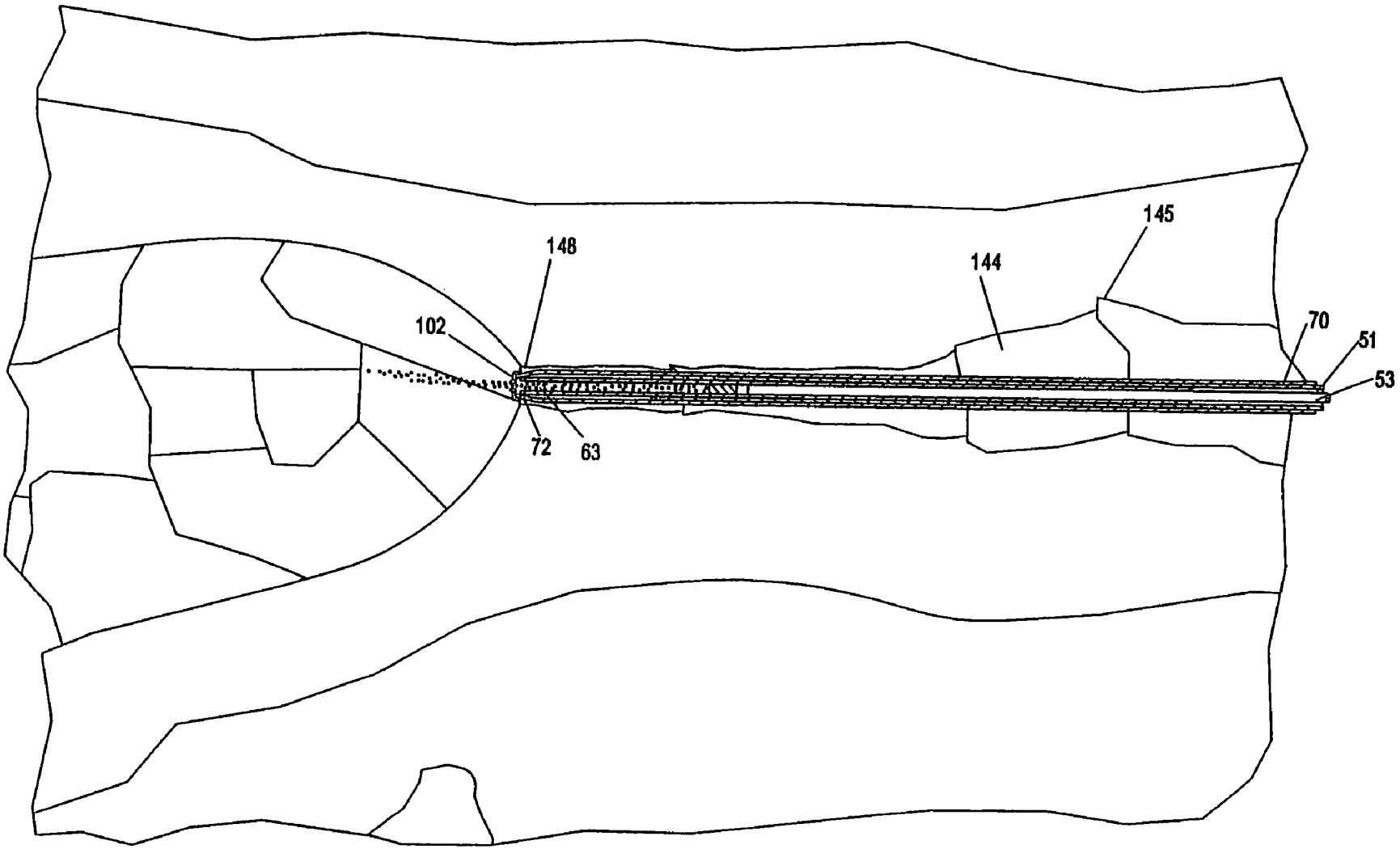
FIG. 8 is a cross-sectional side environmental view of one embodiment of the present invention, showing the tip having been navigated into a bovine cervix and the discharge of semen underway.

FIG. 8 is a cross sectional view of the apparatus of the present invention in the process of injecting semen near the uterine body 148. The coating 102 of the sheath 70 is ruptured through the application of pressure transferred from the manual force of the user on the plunger flange 50 to the seminal fluid in the semen straw. The pressure on the coating 102, causes this surface to rupture allowing for the semen in the semen straw 63 to exit. A skilled breeder can cause this to occur as close as possible to the uterine body 148. To ensure that the semen is properly dispensed, the plunger should be depressed in a slow steady motion.

Figure 9:
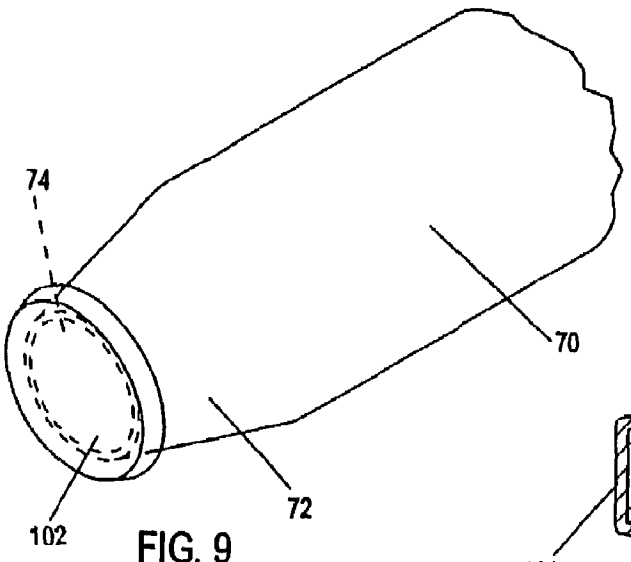
FIG. 9 is a side perspective view of one embodiment of the present invention illustrating a covered tip of an insemination sheath.

FIG. 9 is a view of an embodiment of the covered tip of the sheath of the present invention. The tip 72 of the sheath 70 narrows in diameter before becoming an opening 74. The opening is sealed by a covering 102. In this illustrated example, the covering encloses the opening 74 and extends a distance down the side of the sheath to ensure the opening 74 is fully sealed. The coating 102 is made of a thin material as to not greatly increase the diameter of the tip 72 of the sheath, to ensure easy insertion of the artificial insemination device.

Figure 10:
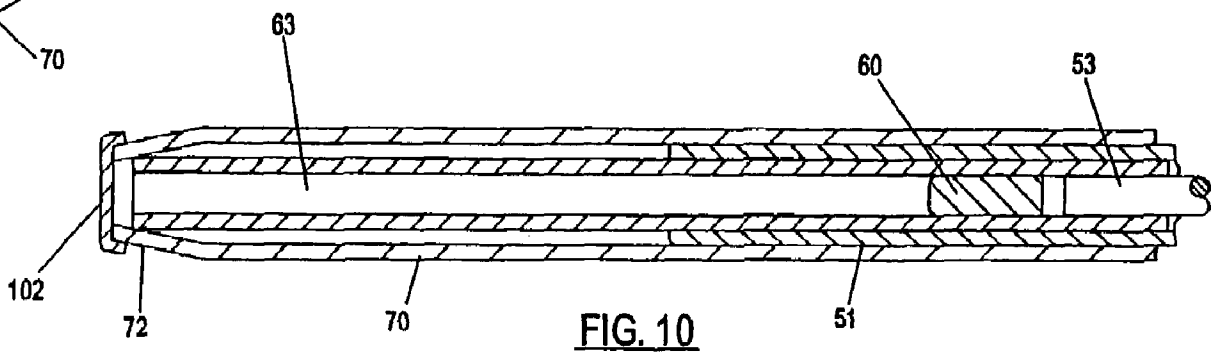
FIG. 10 is a cross-sectional view of one embodiment of an artificial insemination sheath of the present invention having a covered tip prior to rupture.
Figure 11:
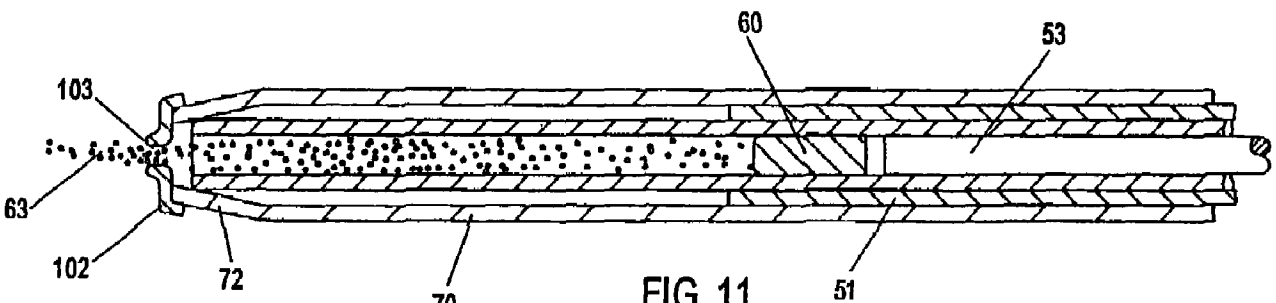
FIG. 11 is a cross-sectional view of the embodiment of FIG. 10 showing the rupture of the seal covering the tip and the release of semen.

FIGS. 10 and 11 are cross sectional views of an embodiment of the artificial insemination sheath of the present invention. FIG. 10 depicts the invention with the coating 102 intact, and FIG. 11 shows the covering ruptured to allow for the expulsion of the semen. The drawing depicts portions of the artificial gun assembly 54. As shown, the sheath 70 covers the shaft 51 of the artificial insemination gun. The semen straw 63 fits within the shaft 51. The tip of the semen straw 63 is pressed against the inside of tip 72 of the sheath, preventing further movement. The semen straw 63 while placed in the shaft 51 of the artificial insemination gun extends a distance beyond the end of shaft 51. The plunger mechanism 53 can be manually extended through the semen straw 63 to eject the semen contained in the straw. As shown, the rupture 103 of the coating 102 is minimal. The coating when ruptured, tears in a manner that it does not create fragments which could be left in the reproductive cavity. In addition, the coating has enough adhesive strength to remain attached to the tip of the sheath even when pressure is applied to plunger mechanism.

In one embodiment, the coating is applied by dipping the very end of the sheath into a fluid polymer solution so that the polymer adheres to the tip of the sheath. The sheath (or group of sheaths, for mass production) is oriented in a vertical direction with the pointed tip facing downward. The end of this tip is moved in a downward direction and dipped into an open reservoir of the solution so that some of the solution adheres to the tip. It is then removed with an upward movement and taken aside to cure. Depending on the material used, this could take about 15 minutes. In some embodiments, the sheath may be rotated while the tip is in the solution, or immediately following the removal of the dipped tip from the solution, in order to assure even distribution of the coating on the tip. After a brief time, which may be before the material has fully cured, the sheath with its dipped tip may be moved to a non-vertical position for drying, further curing, and eventually for packaging and shipment. It is preferred that the dipping, curing and packaging operations be conducted in a sterile or semi-sterile environment, so that the coated sheaths may be delivered in such condition for use by the technician.

In other embodiments, the coating may be applied to the sheath tip by wiping or painting using a sponge, brush or other suitable applicator.

In one embodiment, the coating may be provided as an integral part of the sheath when it is manufactured. In this embodiment, instead of providing a sheath that is open at both ends, the opening at the narrow frustoconical end is closed using a very thin layer of the same material that the sheath is made of. This layer must be thin enough to be ruptured by the normal pressure applied by the insemination gun and plunger.

In another embodiment, a pre-scored area (such as a line or "x") or a tiny pin hole may be provided in the coating. The pre-scored or thinner area provides a weakened portion that is easily ruptured with the normal pressure applied by the insemination gun and plunger. Similarly, the pin hole provides a starting point for rupturing the coating using the normal pressure applied by the insemination gun and plunger. It is to be appreciated that although some small amount of contamination may enter thorough the pin-hole, this small amount could be easily expelled in the cervix before the tip reaches the uterine body using the pre-rupture method described previously.

It is to be appreciated that different versions of the invention may be made from different combinations of the various features described above. In particular, any number of light weight elastic materials can be used to make the coating to the sheath 102. It is to be understood that other variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A method for artificially inseminating an animal comprising:

a. attaching a sheath in which a semen straw has been properly loaded onto an artificial insemination gun, said sheath having a tapered tip with an opening therein adjacent to said semen straw and a thin protective membrane sealing said opening closed;

b. inserting said sheath into a reproductive tract of the animal;

c. maneuvering the tip to a location near a uterine body of the animal; and d. depositing contents of the semen straw by applying pressure using the gun such that fluid pressure from the contents in said semen straw ruptures the membrane allowing the contents of the semen straw to exit through said opening.

2. A method for artificially inseminating an animal comprising:

a. cutting off one end of a semen straw;

b. inserting the semen straw into a hollow tubular sheath having a tapered end with an opening therein such that the cut-off end of said straw is adjacent to said opening, said opening being sealed closed by a protective membrane;

c. inserting a plunger rod into said sheath such that an end of said plunger rod is adjacent to said semen straw;

d. inserting said sheath into a reproductive tract of the animal;

e. maneuvering the tapered end of said sheath to a location near a uterine body of the animal; and f. applying pressure using the plunger rod to fluid in said semen straw such that said fluid ruptures said membrane and expels contents of the semen straw through said opening.

3. The method of claim 2 wherein said membrane has a pre-scored area thereon, and said pressure ruptures said membrane at said pre-scored area.

4. The method of claim 2 wherein the tapered end of said sheath has a frustoconical shape.

5. The method of claim 2 wherein the form of said membrane is selected from the group consisting of (a) integrated with said tubular member, (b) including a weakened area, and (c) combinations thereof.

6. A method for artificially inseminating an animal comprising:

a. cutting off one end of a semen straw;

b. inserting the semen straw into a hollow tubular member having an outer diameter, one end of said member having an opening therein, the opposite end of said member having a tapered end and having a second opening therein, said second opening having an inner diameter that is smaller than said outer diameter, said second opening being sealed closed by a thin membrane, such that the cut-off end of said straw is adjacent to said second opening;

c. inserting a breeding gun having a slidable plunger rod into said tubular member such that said breeding gun fits over said semen straw, and said plunger rod fits behind said semen straw;

d. inserting said tubular member into a reproductive tract of the animal;

e. maneuvering the tapered end of said tubular member to a location near a uterine body of the animal; and f. applying pressure using the plunger rod to fluid in said semen straw such that said fluid ruptures said membrane and expels contents of the semen straw through said second opening.

7. The method of claim 6 wherein said membrane has a pre-scored area thereon, and said pressure ruptures said membrane at said pre-scored area.

8. The method of claim 6 wherein the tapered end of said tubular member has a frustoconical shape.

9. The method of claim 6 wherein the form of said membrane is selected from the group consisting of (a) integrated with said tubular member, (b) including a weakened area, and (c) combinations thereof.

10. A method for artificially inseminating an animal comprising:

a. inserting a semen straw into a breeding gun tube such that an end of said straw extends out from said tube, and a plunger rod fits into the opposite end of said straw;

b. cutting off a portion of the extended end of the semen straw;

c. placing a hollow tubular sheath over said semen straw and tube, said sheath having a tapered end with an opening therein such that the cut-off end of said straw is adjacent to said opening, said opening being sealed closed by a protective membrane;

d. inserting said sheath into a reproductive tract of the animal;

e. maneuvering the tapered end of said sheath to a location near a uterine body of the animal; and f. applying pressure using the plunger rod to fluid in said semen straw such that said fluid ruptures said membrane and expels contents of the semen straw through said tapered end opening.

11. A method for delivering untainted materials to the reproductive tract of an animal comprising:

a. inserting a straw having contents to be delivered to the reproductive tract of an animal into a breeding gun tube such that an open end of said straw extends out from said tube, b. placing a hollow tubular sheath over said straw and tube, said sheath having a tapered end with an opening therein such that the open end of said straw is adjacent to said opening, said opening being sealed closed by a protective membrane;

c. inserting said sheath into a reproductive tract of the animal and maneuvering the tapered end of said sheath to a desired location;

d. depositing contents of the straw by applying pressure such that fluid pressure from the contents in said straw ruptures the membrane allowing the contents of the straw to exit through said opening.

12. A method for delivering untainted materials to the reproductive tract of an animal comprising:

a. inserting a straw having fluid contents to be delivered to the reproductive tract of an animal into a hollow tubular sheath, said sheath having a tapered end with an opening therein such that an open end of said straw is adjacent to said opening, said opening being sealed closed by a protective membrane;

b. inserting said sheath into a reproductive tract of the animal and maneuvering the tapered end of said sheath to a desired location;

c. applying pressure to fluid in said straw such that said fluid ruptures said membrane and expels contents of the straw through said opening.

13. A method for artificially inseminating an animal comprising the steps of:

a. inserting a straw containing semen fluid into a hollow tubular sheath, said sheath having a tapered end with an opening therein such that an open end of said straw is adjacent to said opening, said opening being sealed closed by a protective membrane;

b. inserting said sheath into a reproductive tract of the animal and maneuvering the tapered end of said sheath to a desired location;

c. applying pressure to the fluid in said straw such that said fluid ruptures said membrane and expels said fluid through said opening.

* * * * *